US009761208B1

(12) United States Patent
Klick, Jr.

(10) Patent No.: US 9,761,208 B1
(45) Date of Patent: Sep. 12, 2017

(54) MUSICAL INSTRUMENT ACCESSORY

(71) Applicant: Robert Jerome Klick, Jr., Golden Valley, MN (US)

(72) Inventor: Robert Jerome Klick, Jr., Golden Valley, MN (US)

( * ) Notice: Subject to any disclaimer, the term of this patent is extended or adjusted under 35 U.S.C. 154(b) by 35 days.

(21) Appl. No.: 14/999,353

(22) Filed: Apr. 27, 2016

Related U.S. Application Data

(60) Provisional application No. 62/179,129, filed on Apr. 28, 2015.

(51) Int. Cl.
*G10G 7/00* (2006.01)
*G10D 3/04* (2006.01)

(52) U.S. Cl.
CPC ..... *G10G 7/00* (2013.01); *G10D 3/043* (2013.01); *G10H 2220/005* (2013.01)

(58) Field of Classification Search
CPC ..... G10D 3/043
USPC ..... 84/327, 453, 318
See application file for complete search history.

(56) References Cited

U.S. PATENT DOCUMENTS 6,008,441 A * 12/1999 Steinberger ..... G10D 3/043 84/318
2015/0243261 A1* 8/2015 Skutt ..... G10D 3/043 84/318

* cited by examiner

*Primary Examiner* — Kimberly Lockett

(57) ABSTRACT

A musical instrument accessory with a capo carrying an adjustable connector in turn carrying a screen receiving fixture. When the capo is clamped to the neck of a guitar at a first position, the screen receiving fixture may be arranged and oriented for convenient viewing of a screen carried therein by the guitar musician. When moved to second position, viewing the screen necessitates re-orientation of the screen receiving fixture to accommodate geometry of the second position, which re-orientation is conveniently carried out by re-orientation of the adjustable connector.

14 Claims, 4 Drawing Sheets

MUSICAL INSTRUMENT ACCESSORY

This application claims the benefit of U.S. Provisional Application No. 62/179,129, filed Apr. 28, 2015.

BACKGROUND OF THE INVENTION

The present invention is an accessory for a musical instrument. More particularly, the present invention is an accessory for a stringed instrument, especially a stringed instrument having a neck, such as a guitar, banjo, or ukulele.

Music in sheet form (i.e. sheet music) has for centuries been used to memorialize songs and prompt musicians to perform a predesignated composition. A problem for a musician with sheet music is encountered when moving about. Numerous approaches to holding sheet music for a mobile musician include music holders separately carried by the musician (see U.S. Pat. No. 7,681,855 Cashman (sheet music holder carried about neck)) or carried upon their instrument (see U.S. Pat. No. 7,531,732 Dunlop (sheet music holder carried by a suction cup attachment to body of a guitar.)) In modern times, sheet music may also be displayed upon a screen, for example, the screen of a smart phone or tablet or similar device. The L'MS "Guitar Sidekick" device takes an approach similar to that disclosed in U.S. Pat. No. 7,531,732 Dunlop to use a suction attachment to a guitar body to support a handheld computer or smart phone instead of sheet music.

A capo is an accessory for a stringed instrument such as a guitar, which alters the length and tension of vibrating string sections, upon a plurality of strings, by clamping to the neck of a guitar and engaging and clamping the strings. Examples of capos may be seen in U.S. Pat. No. 7,566,824 Small and U.S. Pat. No. 8,779,292 Steinberger. It is common for musicians to alter the placement of the capo along the neck of the guitar to achieve different tuning effects. Although it is known to provide for carrying a capo, when not in use upon a guitar (see U.S. Pat. No. 6,096,957 Hatfield), it is not known to carry a smart phone screen, displaying music, upon an engaged capo.

Each of the above mentioned patents (U.S. Pat. No. 7,681,855; U.S. Pat. No. 7,531,732; U.S. Pat. No. 7,566,824; U.S. Pat. No. 8,779,292 and U.S. Pat. No. 6,096,957) are hereby incorporated by reference herein in their entirety.

BRIEF SUMMARY OF THE INVENTION

When considered relative to a guitar used with both a capo on the neck and also used with a separate sheet music holder, for example, the above-mentioned L'MS "Guitar Sidekick" type device attached to the guitar body, a potential new combination of utilizing a capo to carry a display screen would have the heretofore unrecognized advantage of reducing the number of accessory items a musician must deal with while performing. However, one significant drawback and issue with such a new combined arrangement is that when the capo is deployed at different positions along the neck of a guitar, the viewing orientation or angle of the screen should be geometrically altered to accommodate its modified position relative to the musician. An elegant approach to accommodating the need for adapting to the demands of a changing viewing angle associated with different capo positions is needed and is provided by the present invention disclosed herein.

The present invention is a musical instrument accessory with a screen receiving and displaying fixture, for example, for receiving and displaying the screen of a handheld computer or smartphone or tablet. The accessory is used with and attached to a stringed instrument, such as a guitar, and most preferably clamped to and thereby engaging the neck of the stringed instrument. An adjustable connector is present between the clamp attachment for the neck of the stringed instrument and the screen receiving fixture. The adjustable connector allows the screen receiving fixture to be oriented or re-oriented such that a screen carried by the screen receiving fixture may be viewed by a musician. In a preferred embodiment, the clamp attachment for the neck is a capo. As is well known, a capo may be applied or clamped upon the neck of a stringed instrument and alter the tension and length of the strings active vibrating segments, thereby resetting the nature of the musical cords produced when strumming or otherwise perturbing the strings. This resetting is primarily a function of placement of the capo along the neck, whether distal or proximate. However, each change in positioning of the capo along the neck of the guitar results in a change of its position relative to the musician playing the guitar and thus, a profound desirability to re-orient the screen receiving fixture.

In another embodiment, the present invention is a method of performing with a guitar, the guitar having a neck. The method includes the steps of providing a handheld screen, the handheld screen displaying music to be performed; providing an accessory including a clamp attachment, an adjustable connector attached to the clamp attachment and a screen receiving fixture attached to the adjustable connector; placing the handheld screen in the screen receiving fixture; clamping the clamp attachment to the neck of the guitar; and, manipulating the adjustable connector such that the handheld screen is conveniently viewable and the music thereon displayed for performance on the guitar. Preferably, the method further includes the steps of unclamping the clamp attachment and clamping at a new position on the guitar; re-manipulating the adjustable connector such that the handheld screen is conveniently viewable from the new position on the guitar. Most preferably, in the method, the clamp attachment is a capo.

DETAILED DESCRIPTION OF THE INVENTION

Figure 1:
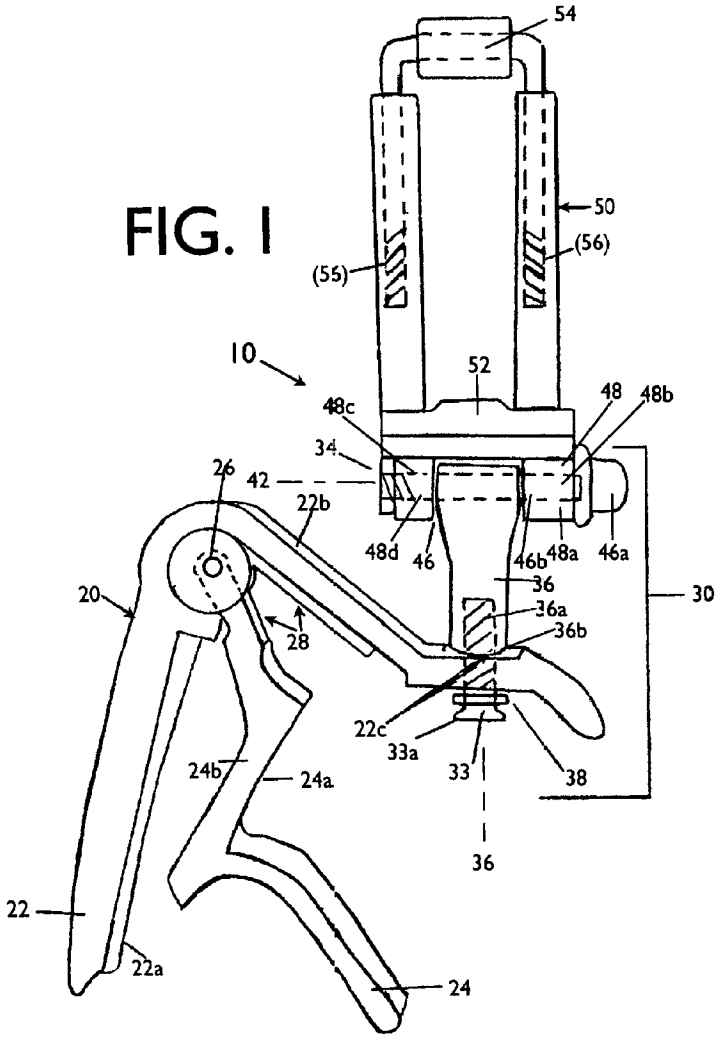
FIG. 1 schematically depicts the main assemblies of the preferred embodiment of the present invention.
Figure 2:
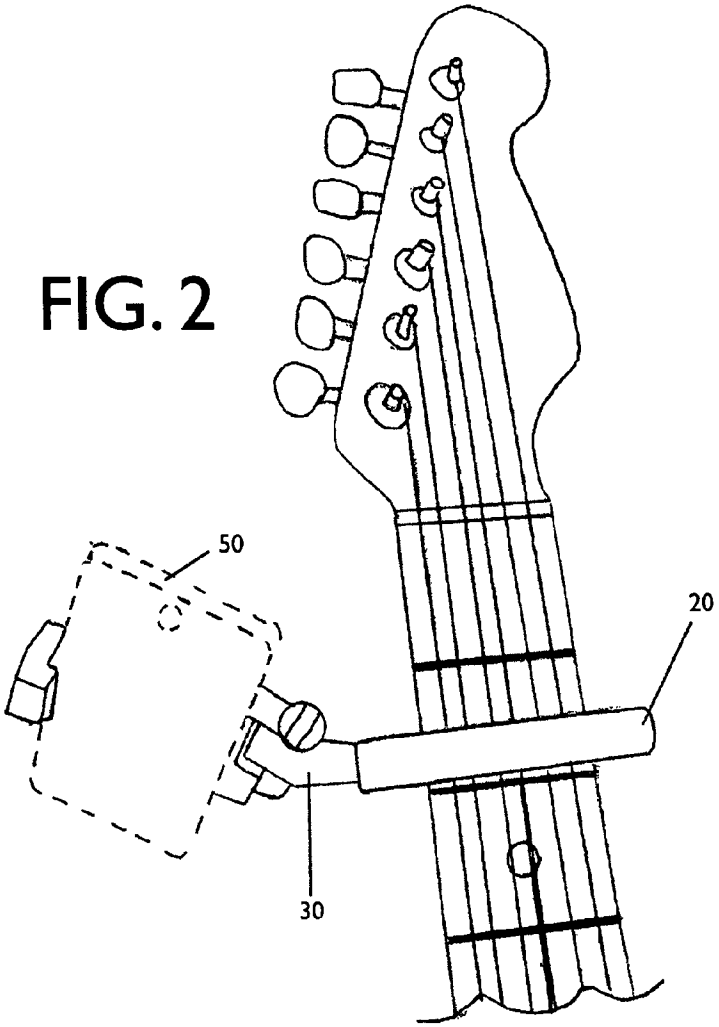
FIG. 2 depicts the preferred embodiment in a first substantially distal attachment situation upon the neck of a guitar (shown as a distal fragment of the guitar neck) with screen display oriented in a first orientation (carrying a handheld screen device shown in outline)
Figure 3:
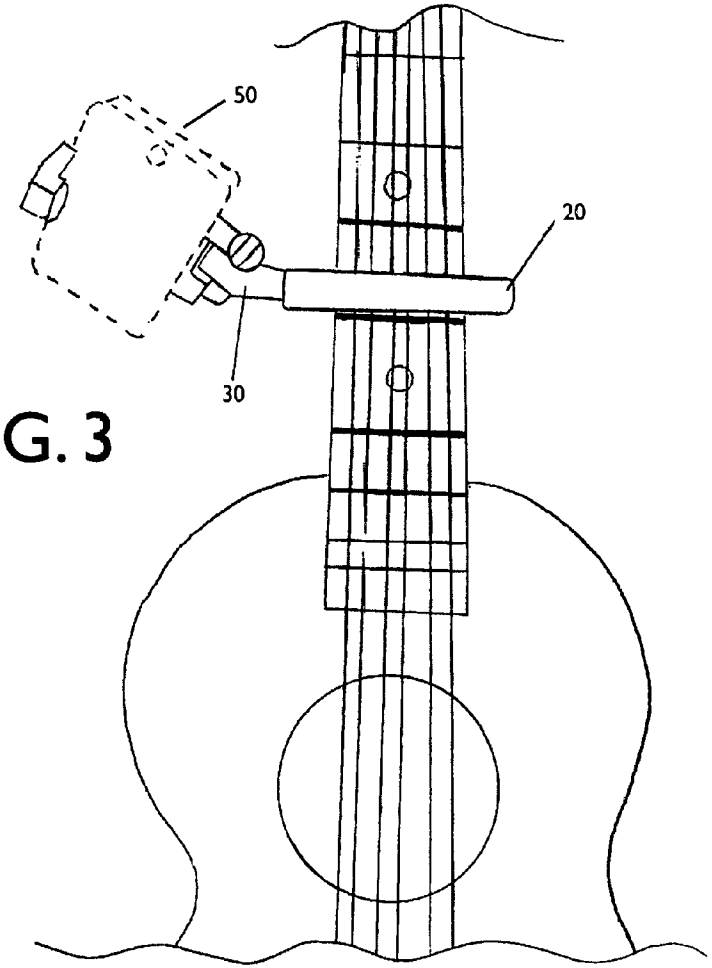
FIG. 3 depicts the preferred embodiment in a second substantially proximal attachment situation upon the neck of the guitar (shown as a proximal fragment of the guitar neck attached to a fragment of the guitar body) with screen display re-oriented to a second orientation (carrying a handheld screen device shown in outline)

In a preferred embodiment, the present invention is a musical instrument accessory 10. As shown in FIG. 1, the accessory 10 has three major sub-assemblies: a capo 20, an adjustable connector 30, and a screen receiving fixture 50.

The capo 20 has a first arm 22 with a top string engaging bumper 22*a* and a lever of the first arm 22*b* with an aperture 22*c* therein. The capo 20 also has a second arm 24 with a guitar neck bottom abutting or engaging arm 24*a*. The first arm 22 and the second arm 24 are connected at pivot 26 and biased by spring 28 such that the neck of a guitar and the associated guitar strings may be clamped between the top string engaging bumper 22*a* and the guitar neck bottom engaging arm 24*b* of the second arm 24 at a range of desirable positions along the neck of the guitar.

The desirable positions along the neck of a guitar may range between a proximal position, adjacent the body of a guitar, to a distal position adjacent the tuning pegs of the guitar. As is well known, distal positioning of a capo, such as capo 20 has a modest effect, modestly raising the frequency of all of the guitar string vibrations, whereas progressively positioning the capo 20 toward the proximal end, adjacent the guitar body has a progressively more pronounced effect of even further raising the frequency of all of the guitar string vibrations.

The adjustable connector 30 has first end 32 with a threaded interior 32*a* within. A threaded fastener 33, with a fastener head 33*a* and threaded fastener shaft 33*b* passes aperture 22*c* of lever of the first arm 22*b* of capo 20, and engages the threaded interior 32*a*. The shaft 33*b*, threaded interior 32*a*, and aperture 22*c* define a first axis 36 whereby rotation may occur within the adjustable connector 30. Preferably, a friction element 38, such as a washer, is present between the fastener head 33*a* and the lever of the first arm 22*b*. When the threaded fastener 33 is tightened into the threaded interior of the first end 32*a* of the adjustable connector 30, rotation is reduced or prevented about first axis 36. Most preferably, the threaded fastener 33 is tightened into the threaded interior 32*a* such that rotation about first axis 36 is achievable with manipulative effort, but does not occur without a conscious application of a manipulative effort:

The adjustable connector 30 also has a second end 34, a second axis 42 of rotation is present in the second end 34, The second axis 42 is distinct from and preferably perpendicular to the first axis 36. The second axis 42 is defined by a threaded bolt 46 with a manually manipulable head 46*a*, a threaded shaft 46*b* and a nut 47. The threaded bolt 46 passes through fork 48 with a first tine 48*a* with an aperture 48*b* and a second tine 48*c* with an aperture 48 *d*, which apertures 48*b* and 48*d* are aligned. A central insert 49 with aperture 49*a*, having bolt 46 passing therethrough, is also situated between tines 48*a* and 48*c*. When the threaded bolt 46 is tightened against nut 47, the frictional element 38 for controlling and squeezing central insert 49 between tines 48*a* and 48*c* to control and limit and potentially prevent rotation about second axis 42. Preferably, the bolt 46 is tightened into the nut 47, preferably captive in the second tine 48*c*, such that rotation may be achieved by manually moving the central insert 49 relative to the fork 48 but undesired further rotation about second axis 42 is prevented. Alternatively, the threaded bolt 46 may be loosened, that desired orientation set, then the threaded bolt 46 re-tightened into nut 47 such that further rotation is prevented.

The screen receiving fixture 50 has a first screen bracket 52 which is connected to the fork 48 and tines 48*a* and 48*b*. The screen receiving fixture 50 also has a second screen engaging bracket 54. An internal spring arrangement 56 urges the second bracket 54 toward the first bracket 52, such that a handheld computer or cellphone or tablet is held therebetween with a screen potentially visible to a musician. To insert a handheld screen such as a cell phone or tablet or Ipod or Palm device or other like displays, the second bracket 54 is pulled against the internal spring arrangement 56 such that the handheld screen is place between the first screen engaging bracket 52 and the second screen engaging bracket 54, then the brackets 52 and 54 are allowed to re-approach each other, thereby capturing the handheld screen. Removal is a reversal of this procedure. This arrangement also allows a variety of handheld devices of differing dimensions to be carried, thereby increasing the versatility of the accessory. Orientation or re-orientation of the screen is achieved by rotation about the first axis 36 and second axis 42, such that the screen carried in the screen receiving fixture 50 is viewable by the musician and may be easily coordinated with the capo 20 position along the neck of the guitar.

Figure 4:
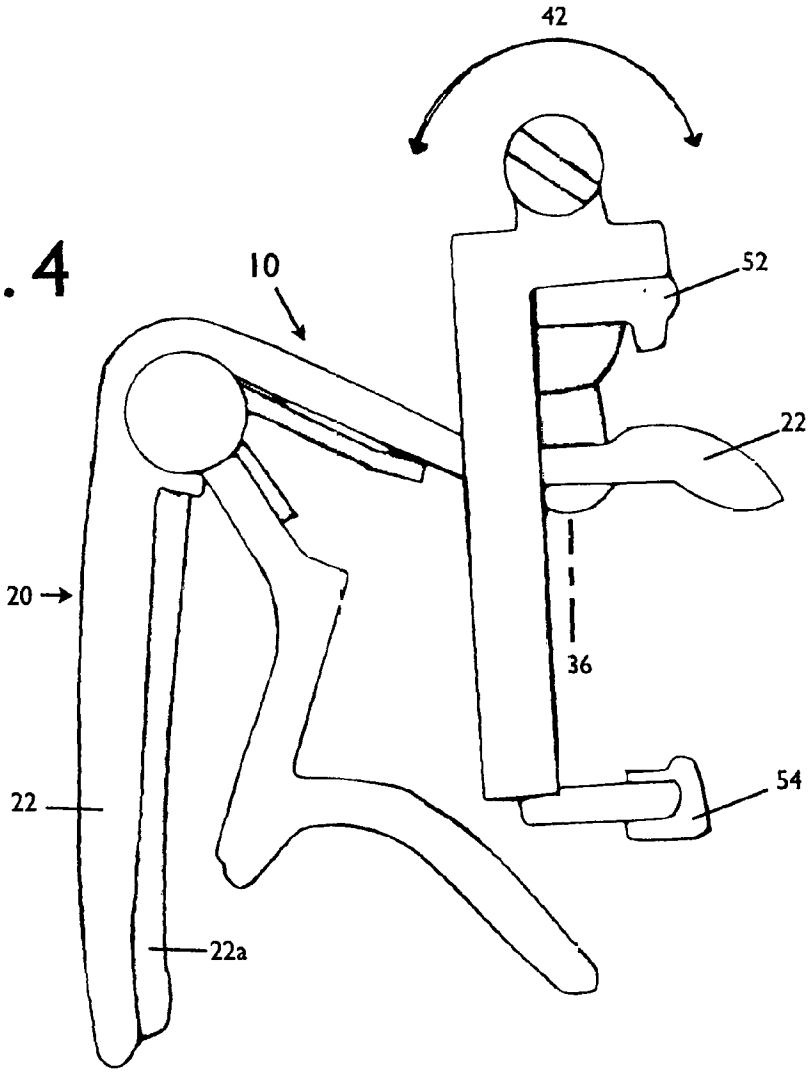
FIG. 4 depicts the preferred embodiment of FIG. 1 folded into a compact condition for storage or for transport and unattached from a guitar neck and not carrying a handheld screen device.

As depicted in FIG. 4, the accessory 10 also has a second surprising capability, that of folding into a compact shape when not in use upon a guitar and not carrying a handheld screen. It is believed that musicians employing the accessory 10 will appreciate the ability to fold the accessory 10 down into a position for compact easy storage. This is particularly convenient since many if not most musicians will want to take their relatively fragile handheld screen and use it as a phone or computer when not in operation displaying music to be played during a performance. In particular, the presence of two rotational axis, first rotational axis 36 and second rotational axis 42 allow the accessory 10, when not carrying a handheld computer or similar screened device, to fold such that the space between the first screen engaging bracket 52 and second screen engaging bracket 54, which typically would accommodate and carry a handheld computer, instead accommodates a portion of lever of first arm 22*b* therebetween. In this compact configuration, the internal spring assemblies 56 are arranged with the same portion of the lever of the first arm 22*b* therebetween and generally are arranged nearly parallel to but spaced apart from the first arm 22 and the top string engaging bumper 22*a* thereon of capo 20. This transformation is accomplished by rotation at one or more typically two of the available axis 36 and 42.

One of ordinary skill will recognize that there are numerous ways to carry a handheld screen other than the spring loaded clamping arrangement described as the screen receiving fixture 50. For example, suction cup devices, rubber or elastic bands, plastic clips, mtl clips, adhesive tape, velcro (hook and pile) arrangements, or magnetic arrangements might be substituted to carry a handheld screen device. Similarly, one of ordinary skill will recognize there are alternative adjustable connectors which might be substituted for the adjustable connector 30 described herein. For example, bendable metals or a plurality of pipe cleaners might be substituted. Similarly, one of ordinary skill will recognize that there are other capo designs than the capo 20 described herein. Those of ordinary skill will further recognize that various modifications can be made to the present invention without departing from the spirit of the invention.

What is claimed is:

1. An accessory for use with a stringed instrument, the stringed instrument having a neck, the accessory comprising:

a clamp attachment adapted for engaging the neck of the stringed instrument;

an adjustable connector, the adjustable connector having a first end and a second end, the first end attached to the clamp accessory;

a screen receiving fixture attached to the second end of the adjustable connector;

and wherein the adjustable connector holds an initial orientation until manipulated to a subsequent orientation then the adjustable connector holds the subsequent orientation, thereby allowing a screen carried in the screen receiving fixture to be conveniently directed for viewing by a musician holding the stringed instrument.

2. The accessory of claim 1, wherein the clamp attachment is a capo.

3. The accessory of claim 1, wherein the adjustable connector has a first axis of rotation and a second axis of rotation, the second axis of rotation distinct from the first axis of rotation.

4. The accessory of claim 3, wherein the first axis of rotation is not parallel to the second axis of rotation.

5. The accessory of claim 3, wherein the second axis of rotation is perpendicular to the first axis of rotation.

6. The accessory of claim 3, wherein the first axis of rotation includes and is defined by a threaded fastener and a threaded receiver therefor.

7. The accessory of claim 6, wherein the lamp attachment is a capo and the capo includes an aperture and the threaded fastener passes through the aperture of the capo and engages internal threads of the threaded receiver of the adjustable connector.

8. The accessory of claim 7, wherein the threaded fastener includes a head and the first axis of rotation further includes a friction element captive between the head and the capo, such that tension applied to the friction element reduces rotation about the first axis of rotation.

9. The accessory of claim 8, wherein the second axis includes a fork having a first tine and a second tine, each of the first tine and second tine having an aperture, the apertures being co-aligned and having a central insert, including an aperture, inserted therebetween, a threaded bolt passing through the apertures and threadably interacting with a nut in the second tine.

10. The accessory of claim 9 and wherein the threaded bolt has a manually manipulable head, which head rotates a threaded shaft to increase frictional resistance to rotation about the second axis of rotation.

11. The accessory of claim 1 wherein the accessory folds to a compact configuration, suitable for storage, when the screen receiving fixture is empty and the clamp attachment is not engaging the neck of a stringed instrument.

12. A method of performing with a guitar, the guitar having a neck, comprising the steps of:

providing a handheld screen, the handheld screen displaying music to be performed;

providing an accessory including a clamp attachment, an adjustable connector attached to the clamp attachment and a screen receiving fixture attached to the adjustable connector;

placing the handheld screen in the screen receiving fixture;

clamping the clamp attachment to the neck of the guitar; and, manipulating the adjustable connector such that the handheld screen is conveniently viewable and the music thereon displayed for performance on the guitar.

13. The method of claim 12 and further comprising the steps of:

unclamping the clamp attachment and clamping at a new position on the guitar;

remanipulating the adjustable connector such that the handheld screen is conveniently viewable from the new position on the guitar.

14. The method of claim 13 and wherein the clamp attachment is a capo.

* * * * *